United States Patent [19]

Zimmerman

[11] Patent Number: 4,850,789

[45] Date of Patent: Jul. 25, 1989

[54] INTERFACING LIFT HITCH

[76] Inventor: Emil F. Zimmerman, Box 332, Richardton, N. Dak. 58652

[21] Appl. No.: 121,344

[22] Filed: Nov. 16, 1987

[51] Int. Cl.[4] ..... B66F 11/00

[52] U.S. Cl. ..... 414/703; 280/416.2; 172/272; 414/723; 414/912; 414/920; 414/607

[58] Field of Search ..... 414/723, 703, 607, 912, 414/920; 280/415 R, 415 A; 172/272, 248; 37/DIG. 3

[56] References Cited

U.S. PATENT DOCUMENTS

| | | | |
|---|---|---|---|
| 2,730,250 | 1/1956 | Harrison . | |
| 3,845,871 | 11/1974 | DiLillo et al. . | |
| 3,995,594 | 12/1976 | Rose | 119/60 |
| 4,002,147 | 1/1977 | Feterl | 119/60 |
| 4,340,240 | 7/1982 | Anderson | 280/415 A |
| 4,389,155 | 6/1983 | Absher | 414/723 |
| 4,477,101 | 10/1984 | Nilsson et al. | 280/461 A |
| 4,482,167 | 11/1984 | Haugrud | 280/415 A |

FOREIGN PATENT DOCUMENTS

| | | | |
|---|---|---|---|
| 1021219 | 3/1966 | United Kingdom | 172/272 |

*Primary Examiner*—Robert J. Spar
*Assistant Examiner*—Donald W. Underwood
*Attorney, Agent, or Firm*—Palmatier & Sjoquist

[57] ABSTRACT

The present invention relates to a lift hitch which mounts on the lifting apparatus of a tractor and has a plurality of quick release mounting devices for mounting implements and where one of the mounting devices is a set of frontwardly protruding hooks that is movable to an out of the way position to accommodate use of the other mounting devices.

17 Claims, 10 Drawing Sheets

INTERFACING LIFT HITCH

The present invention relates to a lift hitch for a tractor having a conventional three-point hitch and, more particularly, to an interfacing lift hatch that is an interface between a farm implement such as a plow and the tractor.

BACKGROUND OF THE INVENTION

The three-point hitch is the standard tractor hitch. The hitch typically consists of three elongate arms connected to and extending rearwardly from a tractor. Each arm has a transversely oriented aperture located in its distal end.

The elongate arms typically attach directly to an implement. An implement having a conventional hitching arrangement has three pins transversely and removably connected to pin connections mounted on a rear face of the implement in a triangular configuration.

To connect an implement having a conventional hitching arrangement with a three-point hitch, the pins of the implement are removed from their pin connections. The distal ends of the elongate arms of the tractor are then aligned in the pin connections and the pins are inserted back into the pin connections and through the apertures of the distal ends, thereby attaching the three-point hitch directly to the implement.

The typical three-point hitch is therefore manually connected to an implement. That is, after he has maneuvered a tractor having a three-point hitch adjacent an implement, the operator of the tractor must leave the tractor seat to connect the implement to the three-point hitch.

Deere and Company having corporate headquarters at John Deere Road, Moline, Ill,, manufactures an interfacing hitch which has been designated the "Quik-Coupler". The Quik-Coupler has an inverted U-shaped frame with three hooks rigidly connected and arranged in a similar geometric configuration as the conventional three-point hitch. A pair of bottom hooks are connected at the lower distal ends of the frame while an upper hook is connected to a central bar joining the two distal ends. The Quik-Coupler attaches as an interface between a tractor and an implement.

In operation, the Quik-Coupler is first conventionally connected to a tractor having a three-point hitch. The operator may then maneuver the tractor and Quik-Coupler adjacent an implement having a conventional three-point hitching arrangement, align the Quik-Coupler with the implement so that each rigidly connected hook is located directly below a pin connection having a transversely oriented pin, and then hydraulically raise the Quik-Coupler so that the hooks cooperate with the pins to thereby attach the Quik-Coupler to the implement.

The Nilsson et al. U.S. Pat. No. 4,477,101 discloses a male coupling frame attached to a tractor and a female coupling frame attached to the implement.

The DiLillo, U.S. Pat. No. 3,848,871 discloses an excavating apparatus for moving a load relative to the ground including a chassis, a load moving member, and a lift assembly movably mounted on the chassis for moving the load moving member relative to the ground.

The Rose, U.S. Pat. No. 3,995,594 discloses a fork lift for carrying large hay bales in combination with a feed rack comprising barred panels through which animals are able to feed on the bales.

The Feterl, U.S. Pat. No. 4,002,147 teaches an apparatus for handling and feeding large hay bales comprising the separable, cooperative combination of a coupler unit adapted to be attached to a three-point lift hitch on a tractor, and a lift fork unit which can be readily converted into a bale feeding container by removably securing a pair of upright wall assemblies to its opposite sides.

The Absher, U.S. Pat. No. 4,389,155 teaches a tractor scoop mechanism which is connected to the rear hydraulic arms of a tractor and pivotally to a tractor scoop. The tractor scoop can then be dumped by pulling a handle on the scoop mechanism which releases the scoop by rotating locking pins from an engaged position and allows the scoop to pivot downwardly into a dumping posture.

The Harrison, U.S. Pat. No. 2,730,250 discloses a loader fork comprising two vertical extending side bars having forwardly and upwardly extending converging arms joined at their upper ends by a bifurcated support element. A pair of legs are pivotally connected to the lower ends of the bars. Chains are connected between the bifurcated support element and a plate connected to the legs. In operation the loader fork is shoved underneath a load, such as pulp wood, when such load is suitably stacked and the fork lifted and moved to proper unloading position.

SUMMARY OF THE INVENTION

The present invention relates to a lift hitch which mounts on the lifting apparatus of a tractor and has a plurality of quick release mounting devices for mounting implements and where one of the mounting devices is a set of frontwardly protruding hooks that is movable to an out of the way position to accommodate use of the other mounting devices.

A feature of the lift hitch is therefore a mounting device that is a set of hooks that are movable to an out of the way position. In the form shown, the hooks are swingably mounted on the lift hitch frame or body for swinging upwardly and inwardly into the body of the lift hitch. When the hooks are so retracted, the front face of the hitch body is planar and unobtrusive. As well as being retractable, the hooks are movable transversely to fit implements of various width.

Another feature of the lift hitch is an automatic latching and locking mounting device which requires that the hooks be out of the way to be functional. This mounting device becomes operational after the set of hooks is retracted and includes a transversely oriented pin that cooperates with an inverted hook adaptable for connection to an implement and a pivotable locking bar and a rigid bottom bar that cooperate with a pivotal latch adaptable for connection to an implement. The pivotable latch is formed to fit snugly to the bottom bar of the lift hitch and to be locked to the bottom bar by the pivotable locking bar. The locking bar is biased to a locked orientation and the pivotable latch is biased to an unlatched orientation so that the implement may be automatically attached to and released from the lift hitch. This mounting device is typically connected to an implement lacking a conventional three-point hitching mechanism.

Another feature of the lift hitch is a drawbar mounting device which also requires that the hooks be out of the way to be functional. This mounting device becomes operational after the set of hooks is retracted and is an elongated, reinforced slot formed in a central, bottom portion of the lift hitch. A drawbar may be rigidly attached in the reinforced slot and pivotally attached at a distal end to an implement. In operation as the tractor and lift hitch tow and turn the implement, the implement may pivot about the distal end of the drawbar and be drawn near the front end of the lift hitch. If the obtrusive hooks were not retracted, the implement would collide with the hooks which could potentially and dangerously hook an odd end protruding from the implement. However, if the obtrusive hooks are retracted, the implement could not only be drawn closer to the lift hitch more safely during turning operations, but could provide a tighter turning radius as well.

Another feature of the lift hitch is a pallet fork mounting device which also requires the hooks to be retracted to be functional. This mounting device becomes operational after the set of hooks is retracted and is a front support plate having a top edge and a planar face. A pallet fork may be attached to the top edge and supported by the planar face of the support plate. In operation, the pallet fork is inserted under or into an article such as a pallet. With the obtrusive hooks protruding from the lift hitch, the length of the pallet fork may be insufficient to lift the article or, if the length is sufficient to lift the article, the article may overbalance the tractor. However, with the obtrusive hooks retracted, the pallet fork may be inserted a sufficient distance into the article to create a safe leverage. Furthermore, with the hooks retracted, the planar unobtrusive front face of the support plate may serve to support the article, especially if the lift hitch is hydraulically tilted so that a portion of the article rests on the front end of the lift hitch.

An advantage of the lift hitch is that it may be connected either to implements having the conventional three-point hitching arrangement or to implemens lacking such a hitching arrangement. For implements with the conventional three-point hitching means, the retractable hooks of the lift hitch are utilized. For implements lacking the conventional three-point hitching means, the retractable hooks are retracted into the lift hitch and the pivotal latching and locking arrangement is used.

Another advantage of the lift hitch is the automatic latch that provides for automatic attachment and detachment of implements from the lift hitch. Since the pivotable latch is biased to an unattached position and the locking bar is biased to a locked or attached position, the operator of the tractor may control the connections between the lift hitch and the implement by controlling the locking bar.

Still another advantage of the lift hitch is that, since the hooks are retractable, implements may be connected closer to the tractor to reduce the danger of overbalancing the tractor.

Still another advantage of the lift hitch is that the retractability of the hooks provide a planar, unobtrusive front end for the lift hitch. Although a hook by the very nature of its structure is efficient for a coupling operation, it is that very same structure that may hinder operation of routine tasks on the farm. For example, transportation of the lift hitch between operations is safer and more efficient with the hooks retracted so as not to interfere with or hook branches, fences or equipment. Moreover, simple storage of the lift hitch is safer and more efficient with the hooks unobtrusively retracted.

Still another advantage of the lift hitch is that each hook is retractable independently of the other hooks. Therefore, if only one hook is needed for an operation such as in hauling logs, or pulling fence posts where one end of the chain is attached to a hook and the other end to the object, then the remaining hooks may be retracted so as not to interfere by hooking or catching the chain or other tools being used in the operation.

Still another advantage of the lift hitch is that the planar, unobtrusive front end, which is provided when the hooks are retracted, may be used as a tool in and of itself. The planar front end of the hitch may be used to push vehicles or implements out of the mud or snow or to support a side of a farm building being constructed or repaired.

DETAILED DESCRIPTION OF THE PREFERRED EMBODIMENT

Figure 1:
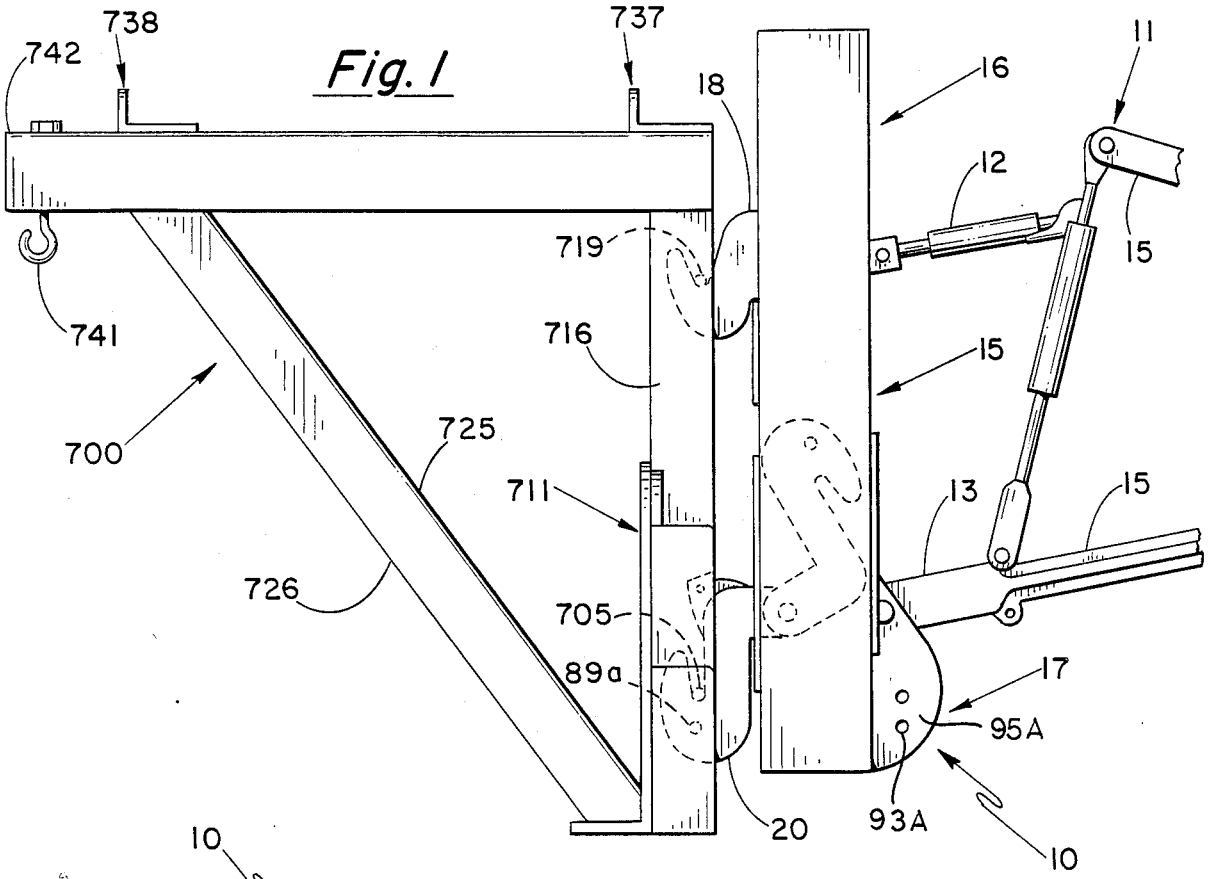
FIG. 1 is a side elevational view of the lift hitch connected to a conventional three-point hitch and a crane implement.
Figure 2:
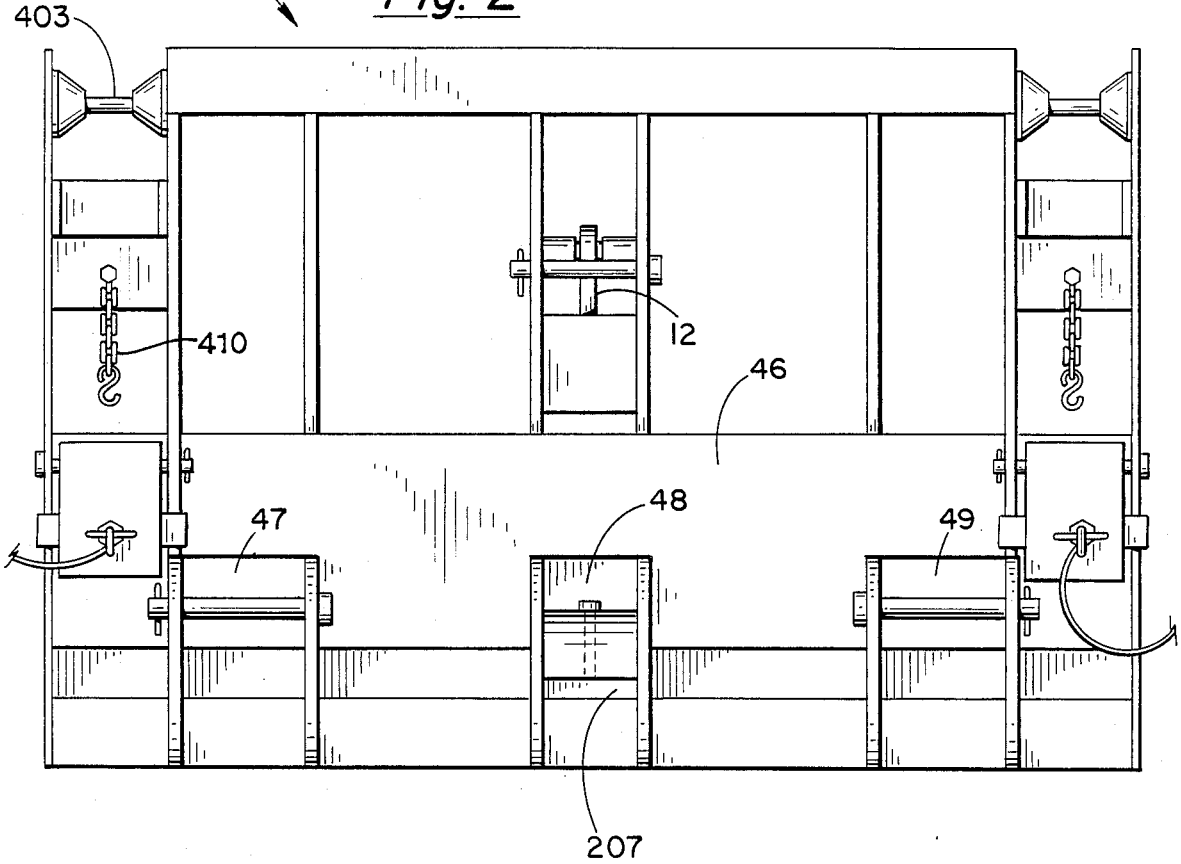
FIG. 2 is a rear elevational view of the lift hitch shown in FIG. 1.

As shown in FIG. 1, a lift hitch 10 is attached to a conventional three-point hitch 11 of a tractor (not shown). The hitch 11 typically has a set of three arms 12–14 extending from a rear end 15 of a tractor. Upper hitch arm 12 is pivotally connected to an upper rear portion 16 of the lift hitch 10. Lower hitch arms 13 and 14 are pivotally connected to opposing ends of a lower rear portion 17 of the lift hitch 10, as shown in FIG. 2.

Figure 3:
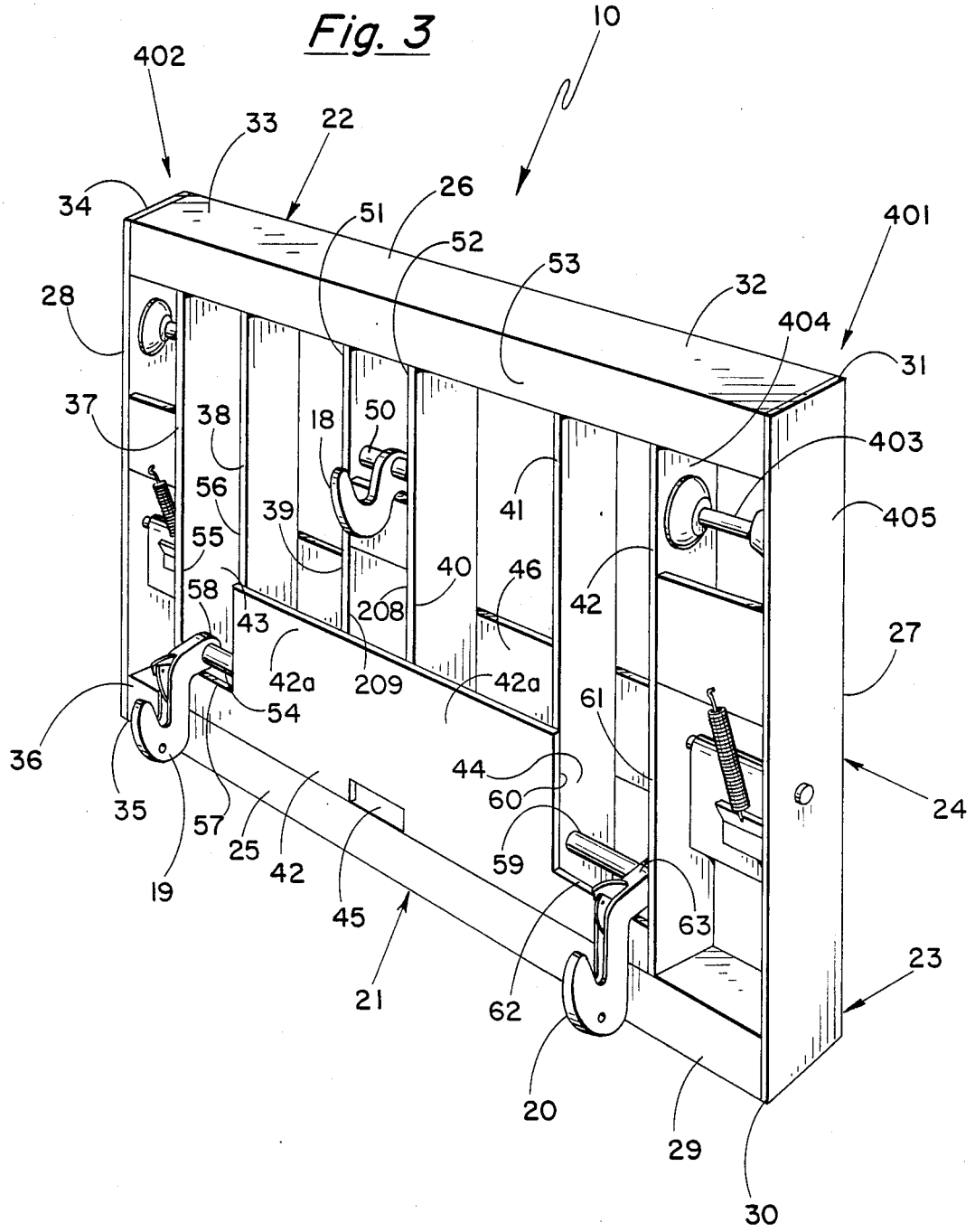
FIG. 3 is a perspective view of the lift hitch shown in FIG. 1.

As shown in FIG. 3, a set of S-shaped hooks 18, 19 and 20 are connected to a front end 21 of the hitch 10 and arranged in a similar geometric configuration as the conventional hitch arms 12, 13, and 14. Hook 18 is pivotally connected to an upper central portion 22 of the front end 21 and hooks 19 and 20 are pivotally connected to and spaced apart on a lower portion 23 of the front end 21. The hooks 18–20 connect and implement such as athe crane 700 to the hitch 10.

The lift hitch 10 may comprise a substantially rectangular frame 24 having a lower bar 25, an upper bar 26, and a pair of outside members 27 and 28. An end 29 of lower bar 25 is rigidly connected, such as by welding, to a lower inside portion 30 of outside member 27. Outside member 27 is rigidly connected at an upper inside portion 31 to an end 32 of the upper bar 26. The upper bar 26 is rigidly connected at an opposing end 33 to an upper inside portion of outside member 28. The outside member 28 is rigidly connected at a lower inside portion 35 to an opposite end 36 of the lower bar 25.

The frame 24 includes a set of interior support members 37, 38, 39, 40, 41, and 42 connecting lower and upper bars 25 and 26. Members 37–42 are substantially parallel to members 27 and 28 and substantially perpendicular to bars 25 and 26.

Members 37 and 38 are attached to frame 24 near member 28. Member 37 is arranged between members 28 and 38. Members 41 and 42 are attached to frame 24 near member 27. Member 42 is arranged between members 41 and 27. Members 39 and 40 are attached to frame 24 between members 38 and 41. Member 39 is arranged near member 38 and member 40 is arranged near member 41.

An integral front support plate 42 is connected to the front ends of members 37, 38, 39, 40, 41, and 42 and outside members 27 and 28, and the bottom bar 25 to extend over about the lower half of front end 21 of frame 24. The plate 42 is substantially rectangular except for a slot 43 partially defined by members 37 and 38, a slot 44 partially defined by members 41 and 42, and a slot 45 partially defined by members 39 and 40.

As shown by FIGS. 2 and 3, an integral rear support plate 46 is connected to the rear ends of members 37, 38, 39, 40, 41 and 42 and the outside members 27 and 28, and the bottom bar 25 to extend over approximately the lower half of rear end 15 of frame 24. The plate 46 is subtantially rectangular except for a set of slots 47, 48 and 49, each of which is partially defined by members 41 and 42, members 39 and 40, and members 37 and 38, respectively.

A removable pin 50 is transversely and rotatably connected between the respective upper ends 51 and 52 of members 39 and 40. The hook 18 is pivotably connected to and transversely slideable on the pin 50. The pin 50 is spaced a sufficient distance from a bottom end 53 of the top bar 26 so that hook 18 is pivotable upwardly and retractable inwardly to an unobtrusive position between the front and rear plates 42 and 46.

A removable pin 54 is transversely and rotatably connected between the respective lower ends 55 and 56 of members 37 and 38. The hook 19 is pivotably connected to and transversely slideable on the pin 54. The slot 43 allows the hook 19 to pivot upwardly and retract to an unobtrusive position between the front and rear plates 42 and 46. An edge 57 of the front plate 42 that partially defines slot 43 is spaced a sufficient distance from the pin 54 to allow a rear edge 58 of the hook 19 to clear the front plate 42 as the hook 19 is being retracted.

A removable pin 59 is transversely and rotatably connected between the respective lower ends 60 and 61 of members 41 and 42. The hook 20 is pivotably connected to and transversely slideable on the pin 59. The slot 44 allows the hook 20 to pivot upwardly and retract to an unobtrusive position between the front and rear plates 42 and 46. An edge 62 of the front plate 42 that partially defines slot 44 is spaced a sufficient distance from the pin 59 to allow a rear edge 63 of the hook 20 to clear the front plate 42 as the hook 20 is being retracted.

Figure 4A:
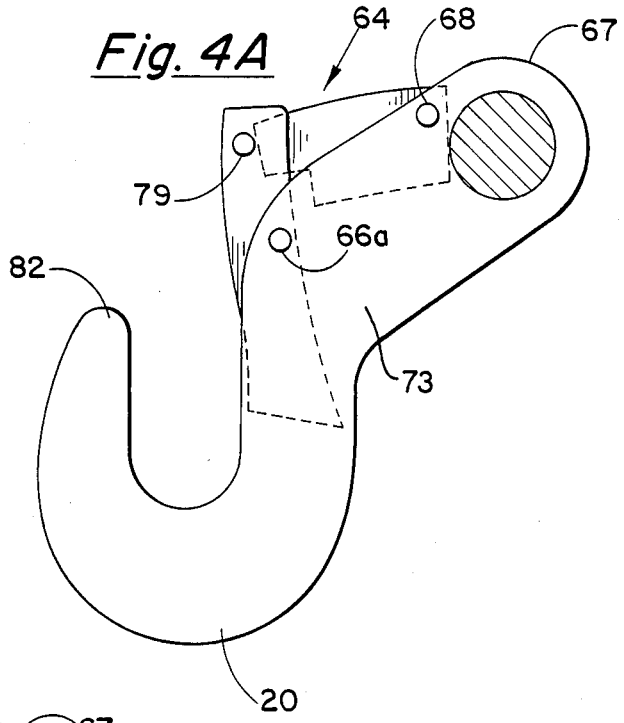
FIG. 4*a* shows a side elevational view of a lower hook.
Figure 4B:
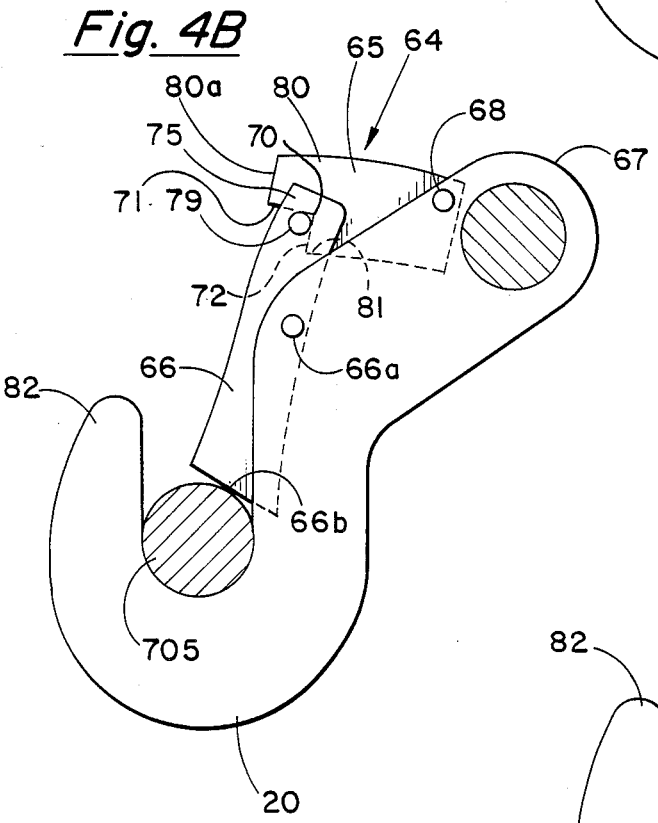
FIG. 4*b* shows the side elevational view of the lower hook shown in FIG. 4*a*.
Figure 4C:
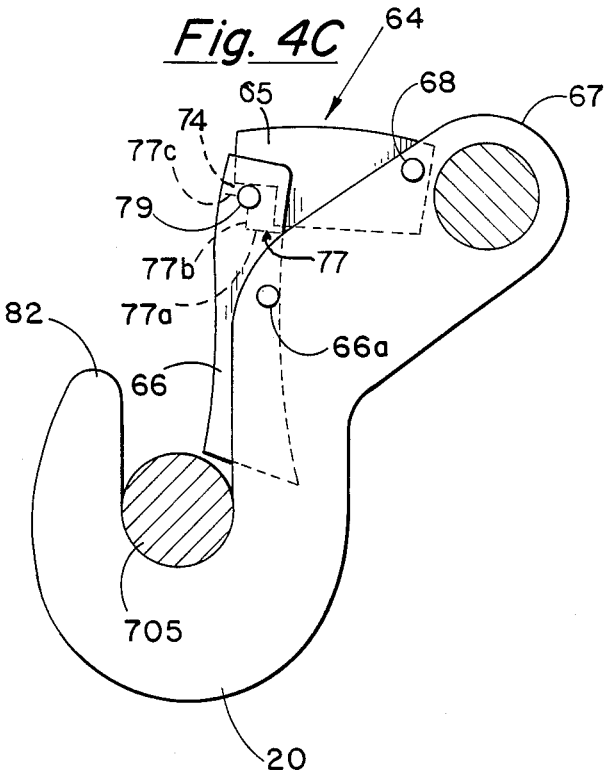
FIG. 4*c* shows the side elevational view of the lower hook shown in FIG. 4*a*.
Figure 4D:
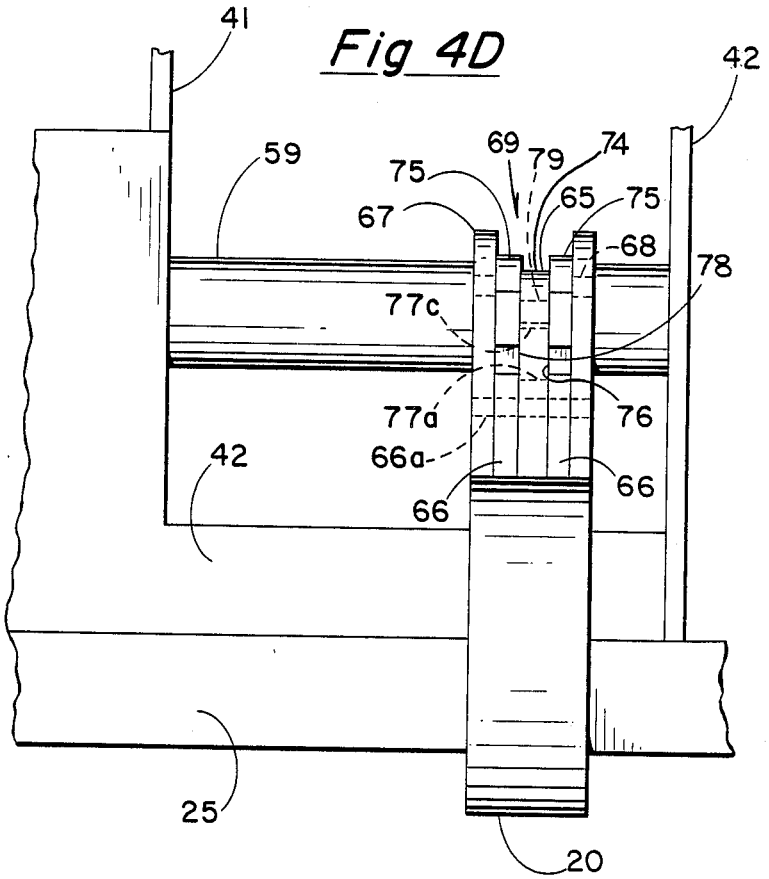
FIG. 4*d* shows a front elevational view of the lower hook shown in FIG. 4*a*.

A lock 64 is connected to each bottom hook 19 and 20 to lock an implement to the lift hitch 10, as shown in FIGS. 4*a–d*. A feature of the lock 64 is a pair of cooperating arms 65 and 66. The first arm 65 is pivotally connected to a top portion 67 of the hooks 19 and 20 by a pin 68. The arm 65 pivots in a sheath 69 formed in hooks 19 and 20, as shown in FIGS. 4*c* and 4*d*. The shape of the arm 65 may be substantially rectangular except for a notch 70 formed by edges 71 and 72 of the arm 65.

The second arm 66 is pivotally connected to a middle portion 73 of the hooks 19 and 20 by a pin 66*a*. The arm 66 pivots in the sheath 69. The shape of the arm 66 may be substantially rectangular and have a distal end 66*b*.

A furrow 74 is formed in a top end 75 of the arm 66 by edges 76, 77 and 78 of arm 66, as shown in FIG. 7*a*. A rotatable roller 79 is transversely connected to the arm 66 and extends transversely across the furrow 74 at the intersection of edges 77*b* and 77*c*, as shown in FIGS. 4*c* and 4*d*. A front end 80 of arm 65 is slideable in furrow 74 and on roller 79.

The arms 65 and 66 are locked when the roller 79 of arm 66 rests in notch 70 at the intersection of edges 71 and 72 of arm 65. In this locked position, edges 71 and 72 and an additional edge 81 of arm 65 lie adjacent edges 77*a*, 77*b*, and 77*c* of arm 66, respectively.

Arm 65 is biased downwardly toward the middle portion 73 of the hooks 19 and 20 and against arm 66. Arm 66 is biased outwardly toward a distal end 82 of hooks 19 and 20.

Figure 5A:
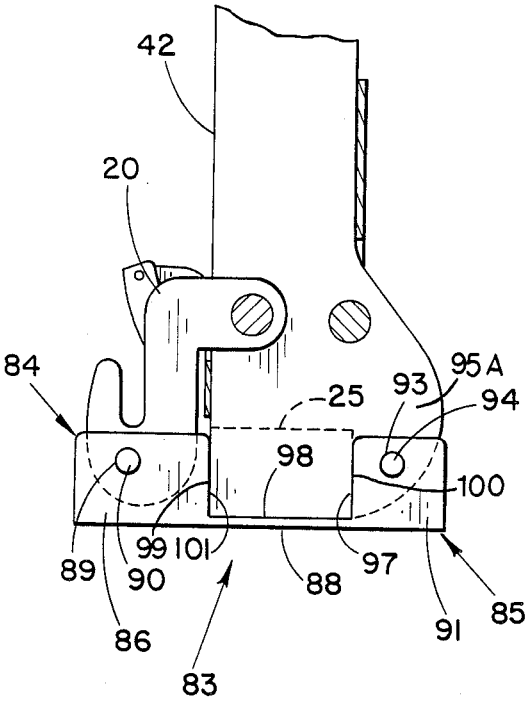
FIG. 5*a* shows a partial side elevational view of a bracket connected to the lift hitch shown in FIG. 1.
Figure 5B:
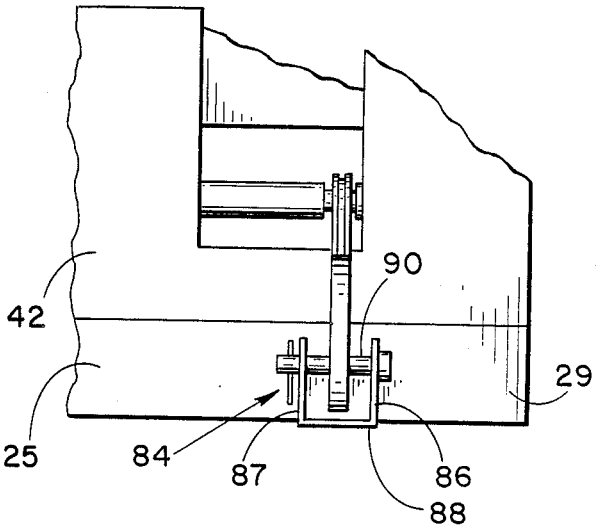
FIG. 5*b* shows a partial front elevational view of the bracket shown in FIG. 5*a*.
Figure 11:
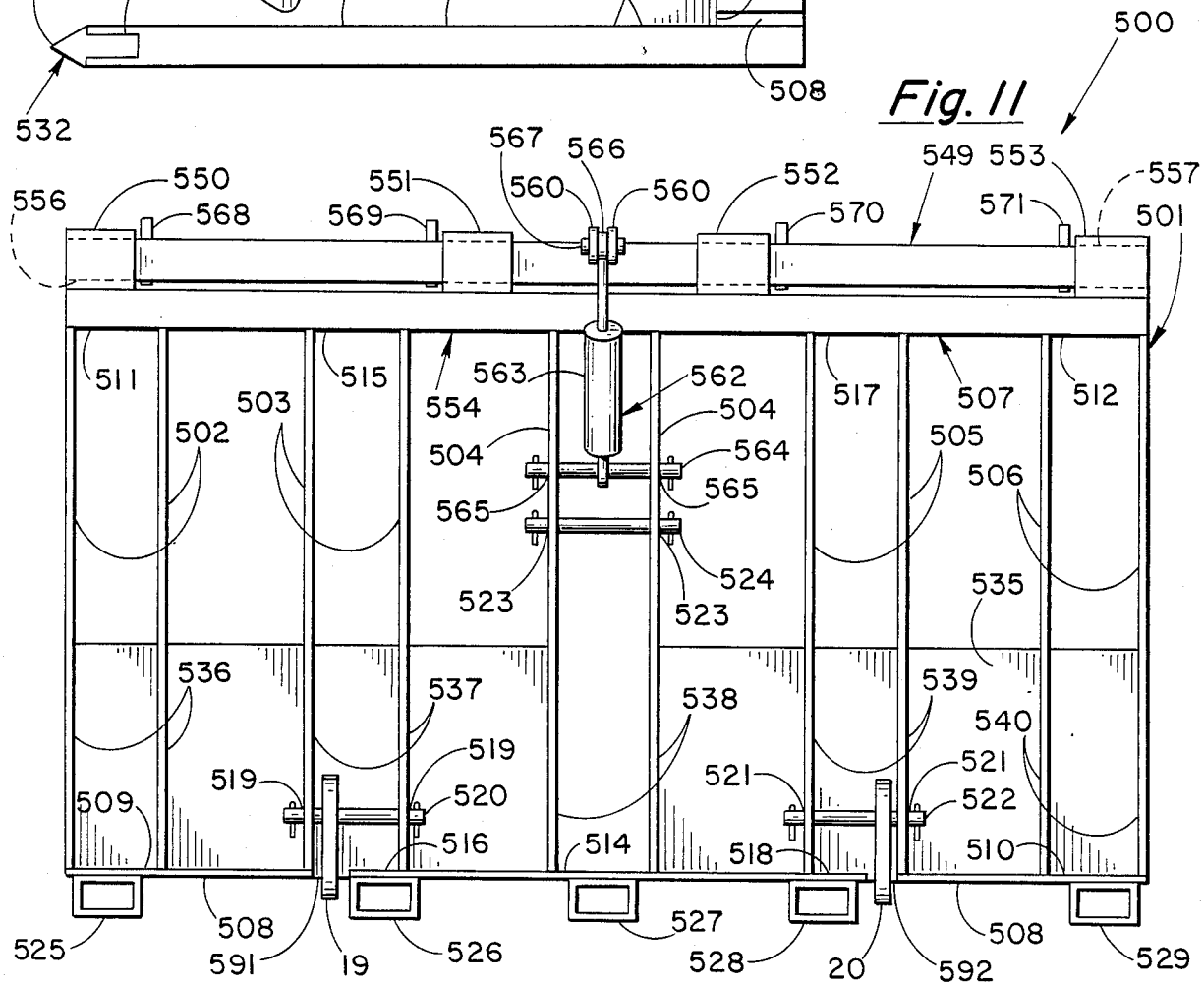
FIG. 11 shows a rear elevational view of the lift hitch and hay handler shown in FIG. 10.

A bracket 83 connects the bottom hook 20 to the frame 24, as shown in FIGS. 5*a–b*. The bracket 83 is substantially U-shaped and has a front end 84 and a rear end 85. End 84 has a pair of ears 86 and 87 extending vertically from the sides of a base 88, as shown in FIG. 11. Each ear 86 and 87 is integrally connected to a side of the base 88. An orifice 89 is formed in ear 86 and 87 for attachment of the end 84 by a removable pin 90 located in an orifice 89*a* formed in hook 20, as shown in FIG. 1.

End 85 has a pair of ears 91 and 92 extending vertically from the sides of the base 88. Each ear 91 and 92 is integrally connected to a side of the base 88. An orifice 93 is formed in each ear 91 and 92 for attachment of the end 85 by a removable pin 94 to a tab 95*a* having an orifice 93*a*, as shown in FIGS. 1 and 5*a*.

Tab 95*a* extends from and is integrally connected to a bottom rear portion of interior support member 42. An edge 96 of the tab 95*a* is connected to a rear edge 97 of the bottom bar 25. It will be appreciated that interior support members 37, 38, 39, 40, and 41 have tab 95*b–f* connected in a similar fashion as tab 95*a* is connected to support member 42.

Bracket 83 is connected to the lift hitch 10 by arranging base 88 adjacent a bottom edge 98 of the bottom bar 25 so that a rear edge 99 of front ear 86 is adjacent a front edge 101 of bottom bar 25 and a front edge 100 of rear ear 91 is adjacent rear edge 97 of bottom bar 25. Ears 87 and 92 are formed similarly to ears 86 and 91, respectively. Ears 86 and 87 and 91 and 92 are arranged on both sides of hook 20 and tab 95*a* respectively and the removable pins 90 and 94 are inserted into the orifices 89, 89*a*, 93 and 93*a* respectively to secure the bracket 83 to the tab 95*a* and hook 20 to secure the pivotable hook 20 to a non-pivotable, substantially rigid orientation. It should be noted that base 88 is non-linear to accomodate the non-linear relationship between tab 95*a* and hook 20. It will be appreciated that hook 20 is secured to the lift hitch 10 in a similar fashion.

Figure 6:
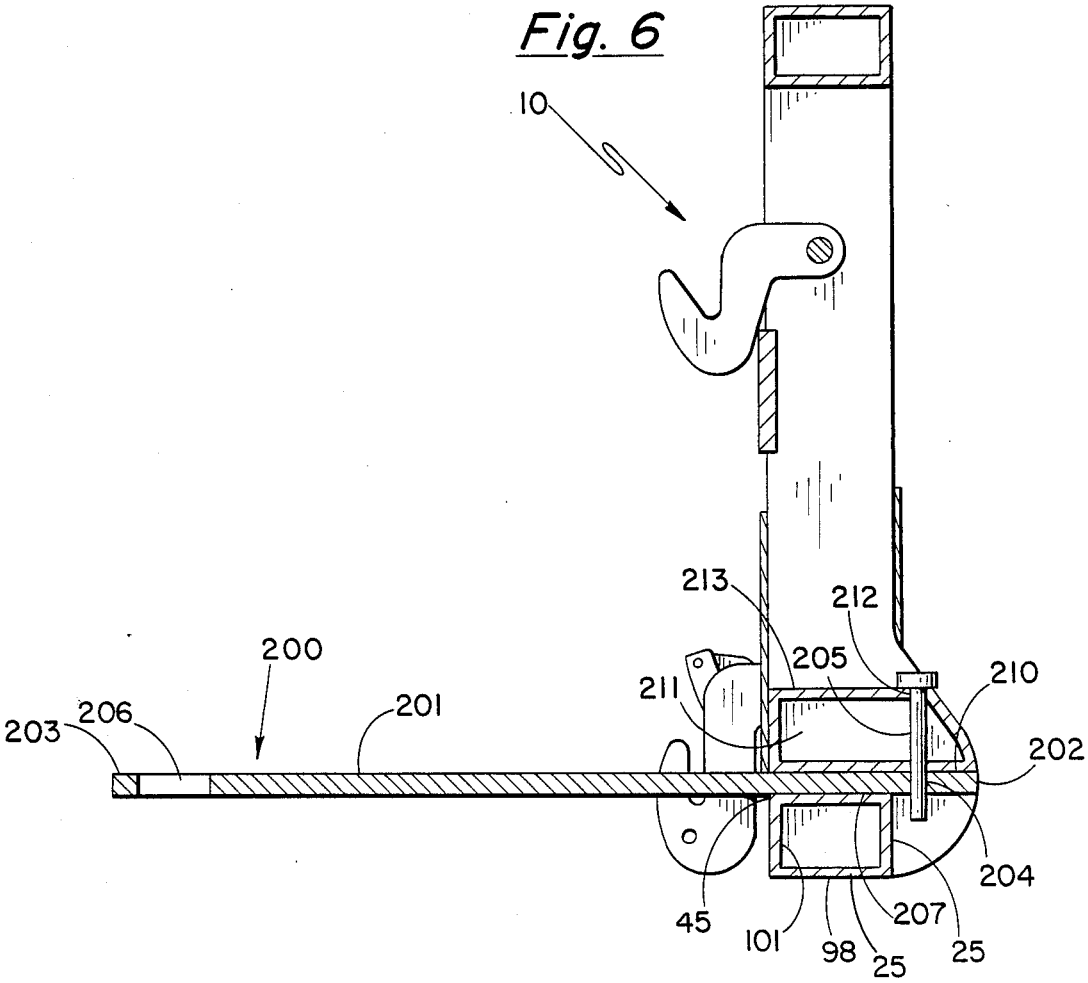
FIG. 6 shows a cross sectional view of the lift hitch shown in FIG. 1 connected to a drawbar.

As shown in FIG. 6, a lifting drawbar 200 may be connected to the lift hitch 10. The drawbar 200 is a planar, elongated body 201 having two ends 202 and 203. An orifice 204 is formed in end 202 for connection to the hitch 10 by a bolt 205. An orifice 206 is formed in distal end 203 for attachment to an implement.

The drawbar 200 is connected to lift hitch 10 by inserting the end 202 in the drawbar-receiving slot 45. The slot 45 is formed by a top end 207 of the bottom bar 25, a pair of respective inner edges 208 and 208 of the interior support members 49 and 40, and a bottom end 210 of a drawbar tabular support member 211 connected to the inner edges 208 and 209 of the interior support members 39 and 40, as shown in FIG. 3.

A perforation 212 is formed in a top end 213 and the bottom end 210 of the support member 211 for the bolt 205. The bolt 205 is removably insertable in perforations 204 and 212 to rigidly connect the drawbar 200 to the lift hitch 10.

It should be noted that the drawbar 200 may take various forms. A hardened boss (not shown) may be formed in distal end 203 about the orifice 206. Furthermore, end 202 may be formed to fit about the top and front ends 207 and 101 of the bottom bar 25 and connect at a right angle to middle portion 201 so that elongated middle portion 201 of the drawbar 200 extends frontwardly in the same plane as bottom end 98 of the bottom bar 25.

Figure 7:
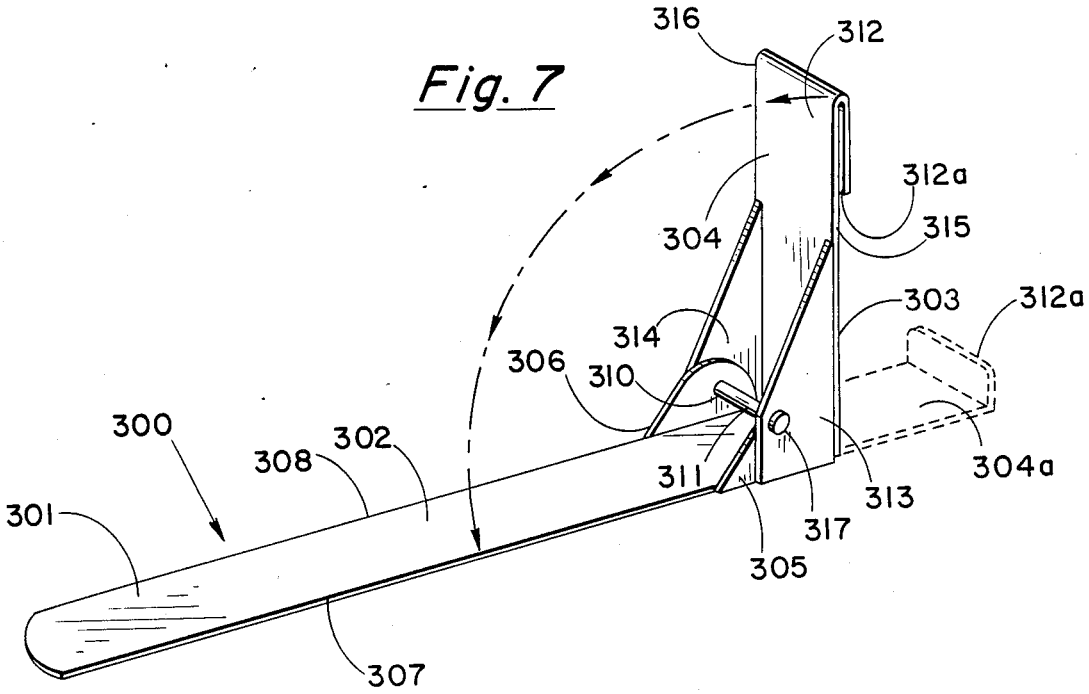
FIG. 7 shows a perspective view of a pallet fork connectable to the lift hitch shown in FIG. 1.

A pallet fork 300 may be mounted on the lift hitch 10. As shown in FIG. 7, a planar, elongate fork 301 is pivotally connected at an end 302 to an end 303 of a grapple 304. The end 302 of the fork 301 has a pair of ears 305 and 306 integrally and rigidly connected at substantially right angles to opposite edges 307 and 308 of end 302 respectively. Ears 305 and 306 have a pair or respective apertures 310 for receiving a removable pin 311.

The grapple 304 has a grappling end 312 and the pivoting end 303. The pivoting end 303 has a pair of flanges 313 and 314 integrally and rigidly connected at substantially right angles to opposite edges 315 and 316 of end 303 respectively. The flanges 313 and 314 taper to end 312 and have a pair of respective apertures 317 for receiving the pin 311. The flanges 313 and 314 of grapple 304 overlap the ears 305 and 306 and are connected by the pin 311.

A second grapple 304*a* may be connected to the elongate fork 301. The second grapple 304*a* extends in a planar and rearwardly fashion from end 312 and is substantially perpendicular to first grapple 304. A second grappling end 312*a* is connected to the rear end of a second grapple to cooperate with bottom bar 25.

Figure 8A:
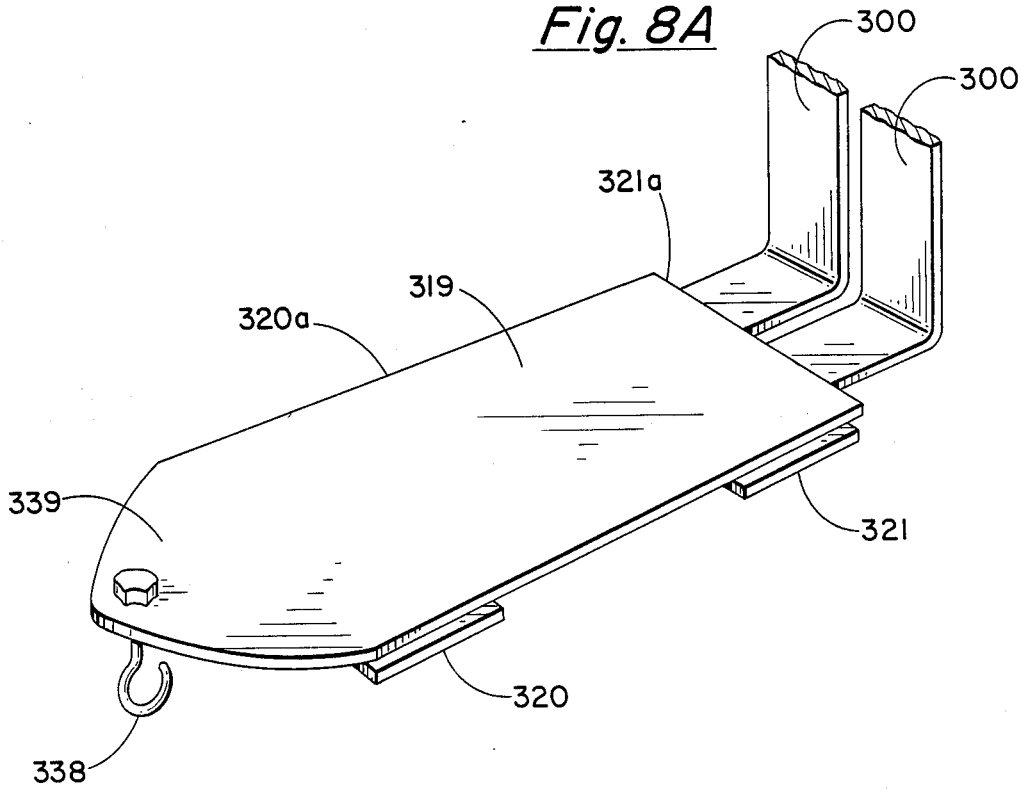
FIG. 8*a* is a perspective view of the crane attachment connectable to a pair of pallet forks which are attachable to the lift hitch shown in FIG. 1.
Figure 8B:
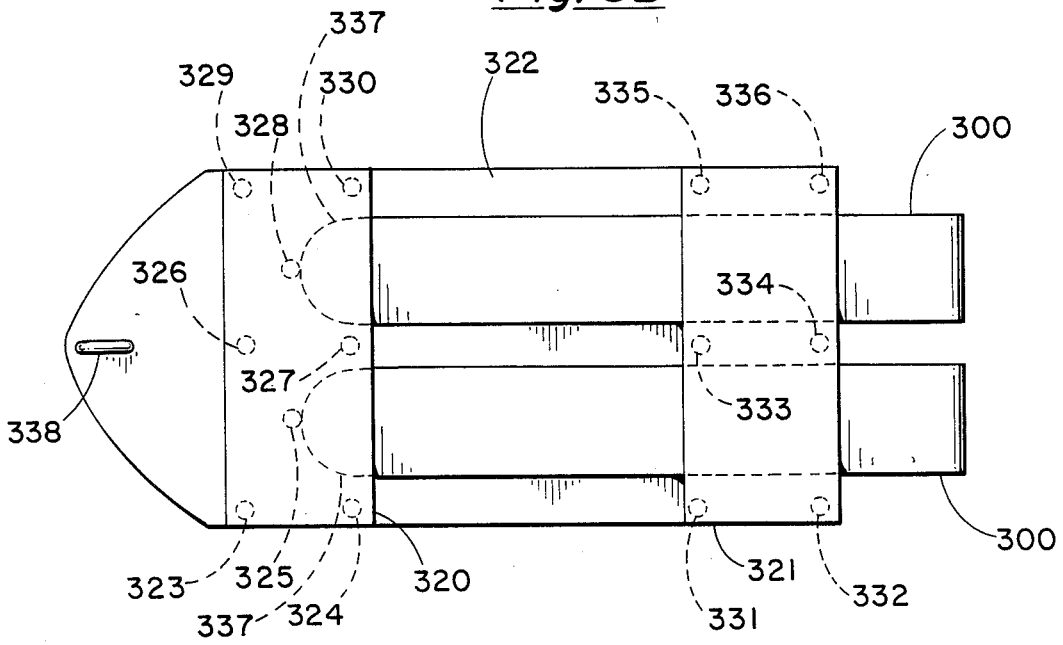
FIG. 8*b* is a bottom elevational view of the crane attachment shown in FIG. 8*a*.

As shown in FIGS. 8*a–b*, a crane attachment 319 may be connected to the lift hitch 10 by the pair of pallet forks 300. A pair of transverse supports 320 and 321 are spacially and transversely connected to a bottom side 322 of the crane attachment 319. The support 320 and 321 are sufficiently spaced from the bottom side 322 to allow a snug insertion of the forks 300. Supports 320 and 321 are connected to ends 320*a* and 321*a* of the crane attachment 319.

A plurality of pins 323–336 connect the supports 320 and 321 to the crane attachment 319. Pins 324, 327, 330, and 331–336 guide the insertion of the forks 300 into the crane attachment 319 and limit lateral movement of the forks 300 after insertion. Pins 325 and 328 abut the distal ends 337 of the forks 300 to control the distance the forks 300 are to be inserted into the crane attachment 319.

A hook 338 is removably attached to an apex 339 integrally connected to end 320 of the crane attachment 319. The hook 338 is removably attached to permit the apex 339 to be inserted into or otherwise cooperate with an article to be lifted before the hook 338 is utilized.

Figure 9A:
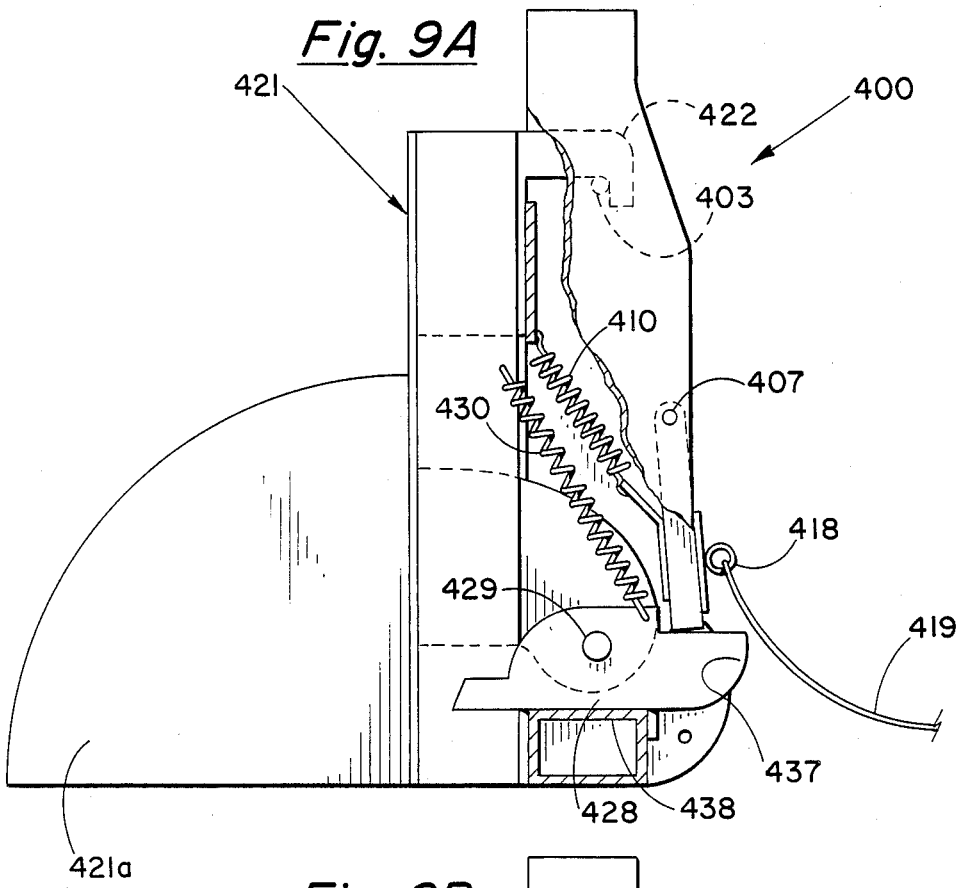
FIG. 9*a* shows a partially cut away side view of the lift hitch shown in FIG. 1 connected to an automatic latching and locking device which in turn is connected to a scoop.
Figure 9B:
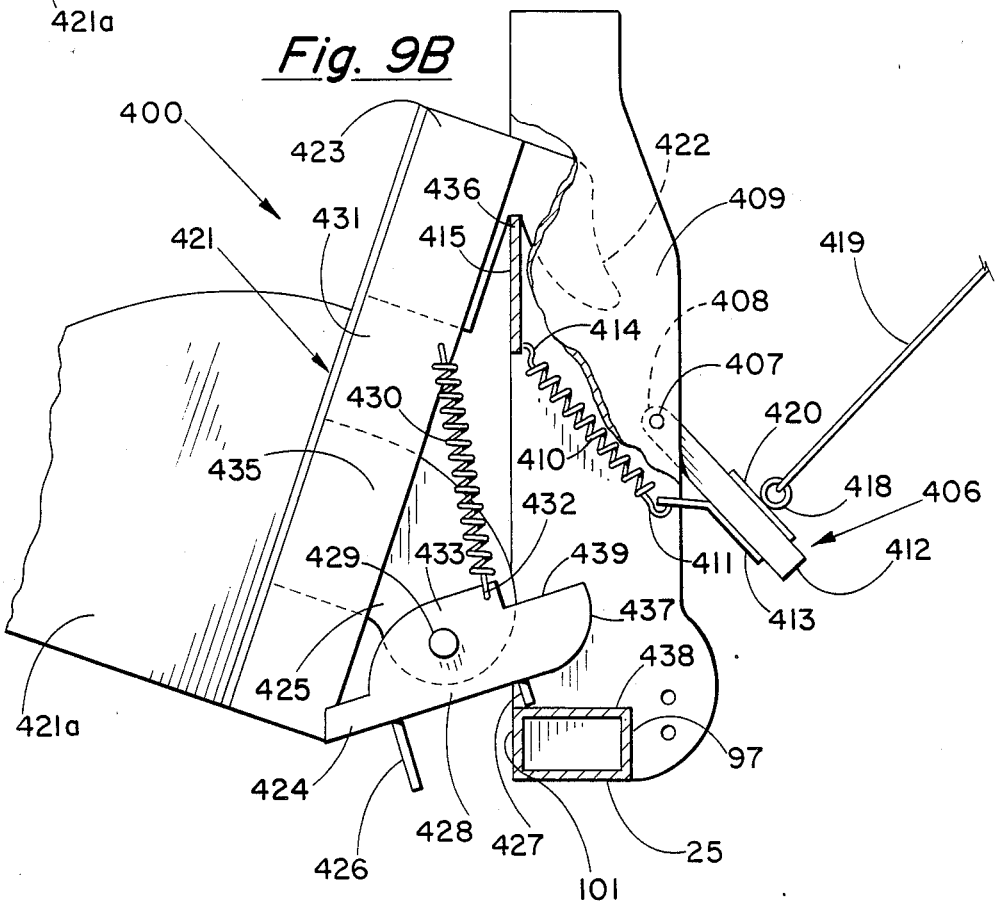
FIG. 9*b* shows a partially cut away side view of the lift hitch shown in FIG. 1 connected to an alternate embodiment of the automatic latching and locking device shown in FIG. 9*a*.

As shown in FIGS. 9*a–b*, an automatic latching and locking mounting device 400 is connected to either side 401 and 402 of the lift hitch 10. The mounting device 400 connected to side 401 may include a pin 403 removably connected centrally to a pair of respective upper portions 404 and 405 of support members 42 and 27. The mounting device 400 further includes a pivotal locking bar 406 and the rigid bottom locking bar 25.

The locking bar 406 is pivotally connected to the support members 42 and 27 by a pin 407. The pin 407 is connected to a top end 408 of the locking bar 406 and a rear, middle portion 409 of the support members 42 and 27. The width of the locking bar is less than the distance between support members 42 and 27 so that the locking bar 407 is movable therebetween.

A coil spring 410 connects the locking bar 406 to the lift hitch 10. An end 411 of the coil spring 410 is connected to a lower portion 412 of the locking bar 406 by a connection 413. An opposite end 414 of the coil spring 410 is connected to a front plate 415 connected to a pair of respective front portions 416 and 417 of the support members 42 and 27. The locking bar 406 is biased toward the front plate 415 by the coil spring 410. A hook 418 and a tractor connection 419 are connected to a rear end 420 of the looking bar 406 for pivoting the locking bar 406 rearwardly.

A latch 421 adapted for connection to an implement such as a scoop 421*a*, cooperates with the mounting device 400 to connect an implement to the lift hitch 10. The latch 421 includes an inverted hook 422 connected to a top, rear portion 423 of the latch 421 and a pivotal clamp 424 connected to an ear 425 extending rearwardly from the latch 421. A pair of legs 426 and 427 are connected to and protrude downwardly from a bottom end 428 of pivotal clamp 424. A pin 429 pivotally connects the clamp 424 to the ear 425. The clamp 424 may extend over both sides of ear 425.

A coil spring 430 connects the clamp 424 to a main bar or support 431 of the latch 421. An end 432 of the coil spring 430 is connected to a top portion 433 of the clamp 424. An opposite end 434 of the coil spring 430 is connected to a rear portion 435 of the main bar 431. The pivotal clamp 424 is biased upwardly and frontwardly and toward the main bar 431 by the coil spring 430.

The latch 421 cooperates with the mounting device 400 by first maneuvering the inverted hook 422 to cooperate with the pin 403, or as shown in FIGS. 3 and 9*a*, alternatively, to rest on a top end 436 of the front plate 415, as shown in FIG. 9*b*. A front end 437 of the pivotal clamp 424 is then inserted into the lift hitch 10 between upright support members 42 and 27, against connection 413 and locking bar 406 until the bar 406 is pivoted rearwardly and legs 426 and 427 clamp about the respective front and rear ends 101 and 97 of the bottom locking bar 25 and end 428 of the clamp 424 rests on a top edge 438 of the bottom locking bar 25. Once the clamp 424 has clamped about the bottom bar 25, the pivotal locking bar 406 is urged frontwardly by the coil spring 410 to abut a top edge 439 of the clamp 424, thereby locking the clamp 424 to the lift hitch 10.

Figure 10:
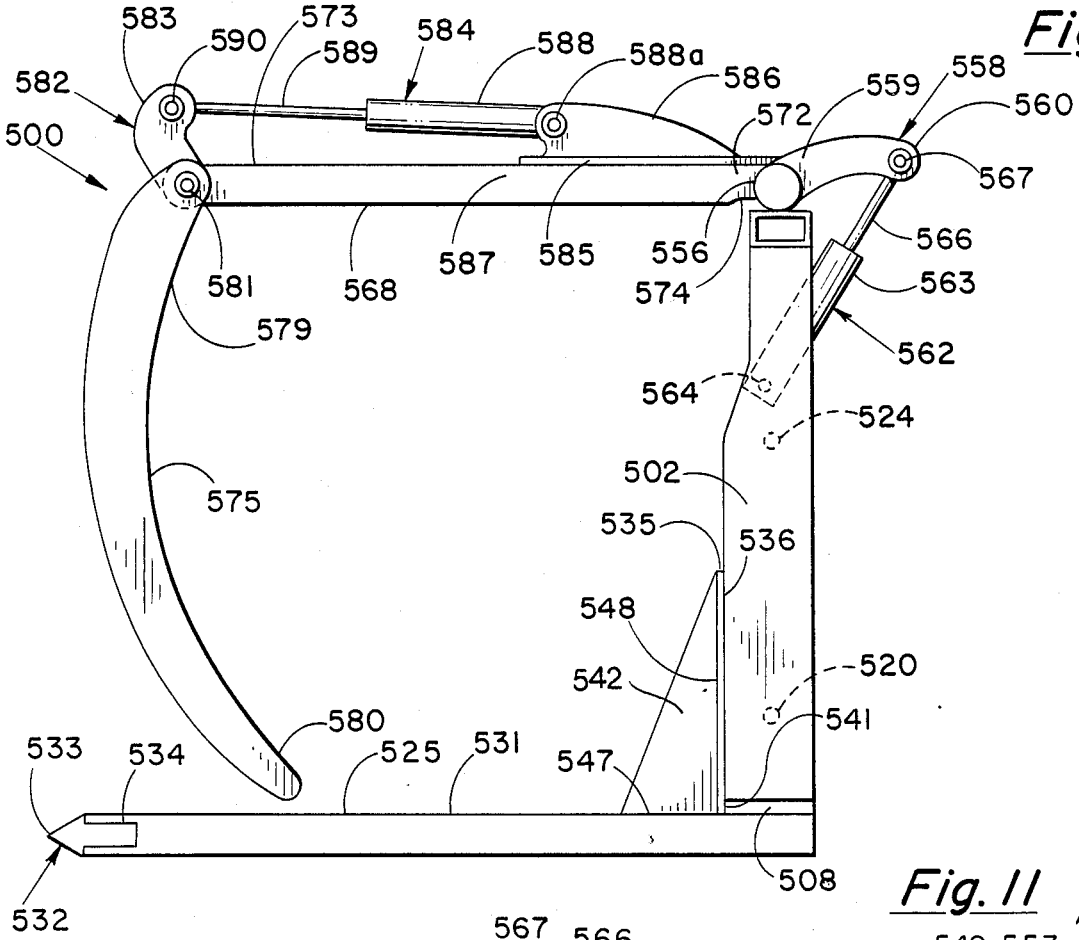
FIG. 10 shows a side elevational view of the lift hitch shown in FIG. 1 connected to a hay handler implement.

A fast hookup hay handler 500, as shown in Figs. 10 and 11 is connectable to the lift hitch 10 utilizing the quick release hooks 18, 19 and 20.

The hay handler 500 has a frame 501 having five pairs of upright support members 502, 503, 504, 505 and 506, a top bar 507, and a bottom bar 508. Members 502 and 506 are rigidly connected to opposing ends 509, 510, 511, and 512 of the bars 507 and 508. Members 504 are rigidly connected to respective middle portions 513 and 514 of the top and bottom bars 507 and 508. Members 503 are rigidly connected to respective portions 515 and 516 of bars 507 and 508 and spaced evenly between members 502 and 504. Members 505 are rigidly connected to respective portions 517 and 518 of bars 507 and 508 and spaced evenly between members 504 and 506.

Members 503 are spaced apart and have perforations 519 for a removable hitch pin 520 to which lower hook 20 of the lift hitch 10 may attach. Members 505 are spaced apart and have perforations 521 for a removable hitch pin 522 to which lower hook 19 of the lift hitch 10 may attach. Members 504 are spaced apart and have perforations 523 for a removable hitch pin 524 to which upper hook 18 of the lift hitch 10 may attach. It should be noted that members 502 are spaced apart and that members 506 are spaced apart.

A set of elongate teeth 525, 526, 527, 528, and 529 are rigidly connected to and extend frontwardly of a bottom end 530 of bottom bar 508 at substantially right angles to bottom bar 508 and support members 502, 503, 504, 505, and 506. Teeth 525, 527, and 529 are connected to bottom bar 508 substantially in line with members 502, 504, and 506 respectively. Teeth 526 and 528 are connected to the bottom bar 508 slightly off-center from respective members 503 and 505 so that a portion of each tooth 526 and 528 lies to the inside of members 503 and 505.

Each elongate tooth 525, 526, 527, 528, and 529 has an elongate body 531 and a tapered, distal end 532 typically comprised of a hardened material. The tapered end 532 may have a pointed head 533 and a tail 534. The tail 534 may be recessed into the elongate body 531.

A planar front support plate 535 is rigidly connected to lower front ends 536, 537, 538, 539, and 540 of support members 502, 503, 504, 505, and 506. The plate 535 may also be connected to the front end 541 of the bottom bar 508.

A plurality of braces 542 connect the teeth 525, 526, 527, 528, and 529 to the front support plate 535. Each brace 542 is triangular and has a bottom end 547 and a rear end 548. Bottom end 547 is connected to a middle portion of the top end of the body 531 of each tooth 525–529 and the rear end 548 is connected to the front support plate 535.

A rack shaft 549 is rotatably connected to the frame 501. The shaft 549 is rotatably mounted in a set of bearings 550, 551, 552, and 553 which are connected to a top end 554 of the top bar 507. The bearings 550–553 are evenly spaced on the top bar 507 with bearings 550 and 553 located at opposing ends 511 and 512, respectively. Bearings 550 and 553 encompass the opposite ends 556 and 557 of the shaft 549.

A first pivot arm 558 is connected to and extends rearwardly from the shaft 549. The pivot arm 558 may have a concave end 559 and a distal end 560. The concave end 559 is connected axially to a middle portion 561 of shaft 558.

A first hydraulic cylinder 562 is pivotally connected to the distal end 560 of the pivot arm 558 and pivotally connected to the frame 501. A first end 563 of the cylinder 562 is pivotally connected to a removable pin 564 which may be pivotally connected to support members 504 having perforations 565 for the pin 564. A linearly movable second end 566 extends obliquely rearwardly and upwardly from end 563 and is pivotally connected to the distal end 560 of the pivot arm 558 by a pin 567.

A first set of forks 568, 569, 570, and 571 is axially connected to and extend frontwardly from the rack shaft 549. Each fork has a proximal end 572 and a distal end 573. An inlet 574 is formed in the first end 572 to allow the forks 568–571 to pivot downwardly without interference from the top bar 507.

A second set of forks 575 is pivotally connected to and extend downwardly from the first forks 568–571. Each fork 575–578 has a proximal end 579 and a distal pointed end 580 and tapers from end 579 to end 580 in a curvilinear fashion so that pointed end 580 extends somewhat rearwardly. The proximal ends 579 are rigidly connected to a transverse rod 581, which is pivotally connected to the distal ends 573 of the first forks 568–571.

A second pivot arm 582 is rigidly connected axially to a middle portion of the transverse rod 581. The arm 582 is L-shaped and has a distal end 582.

A second hydraulic cylinder 584 is connected to the second pivot arm 582 and the first forks 568–571. A transverse bar 585 having an ear 586 is connected to the top, rear ends 587 of the first forks 568–571. The ear 586 is connected to a middle portion of the bar 585. A first end 588 of the cylinder is pivotally connected to the ear 586 by a pin 588*a*. A linearly movable end 589 is pivotally connected by a pin 590 to the distal end 582 of the second pivot arm 582.

Figure 12:
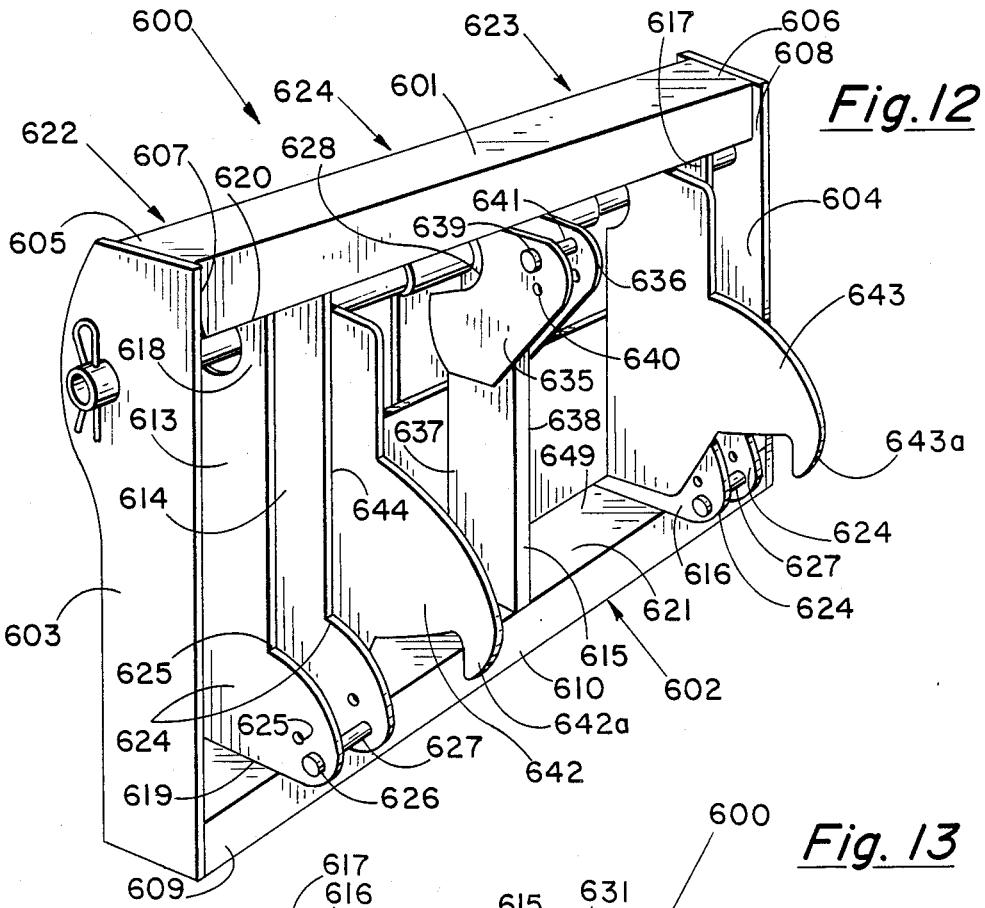
FIG. 12 shows a perspective view of a pallet fork implement connectable to the lift hitch shown in FIG. 1.
Figure 13:
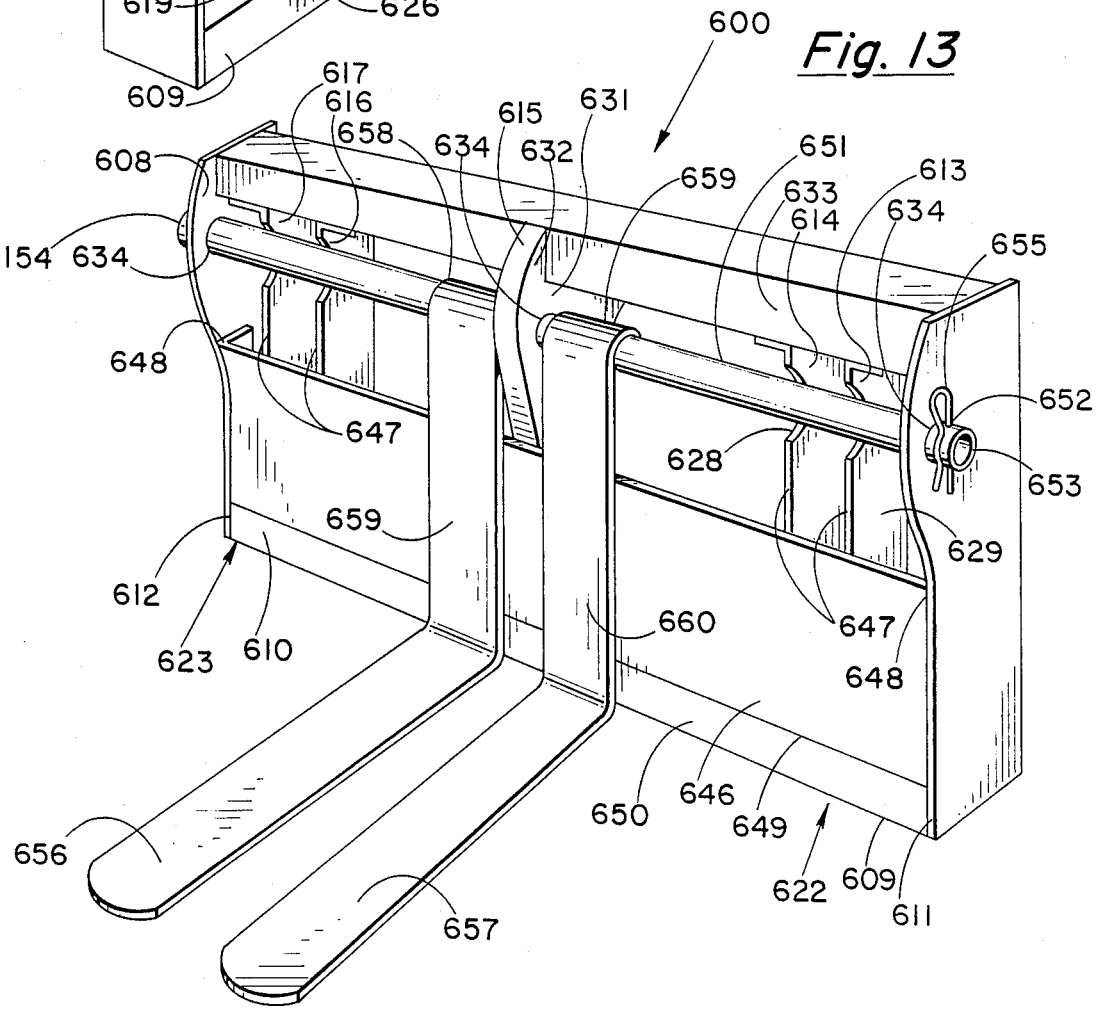
FIG. 13 shows a perspective view of the pallet fork shown in FIG. 12.

A quick release pallet fork implement 600, as shown in FIGS. 12 and 13, is connectable to the lift hitch 10 utilizing the quick release hooks 18, 19 and 20.

The pallet fork implement 600 has a top bar 601 and a bottom bar 602 connected by a pair of outer upright support members 603 and 604. A pair of opposite ends 605 and 606 of top bar 601 are connected to a pair of respective upper inside portions 607 and 608 of members 603 and 604. A pair of opposite ends 609 and 610 of bottom bar 602 are connected to a pair of respective lower inside portions 611 and 612 of members 603 and 604.

A plurality of inner upright support members 613, 614, 615, 616, and 617 are connected to top and bottom bars 601 and 602. A pair of opposite ends 618 and 619 of member 613 are connected to a bottom end 620 of top bar 601 and a top end 621 of bottom bar 602, respectively. It will be appreciated that member 614, 615, 616, and 617 are connected to bars 601 and 602 in substantially the same manner as member 613. Adjacent members 613 and 614 are connected at an end 622 of the implement 600. Adjacent members 616 and 617 are connected at an end 623 of the implement 600. Member 615 is connected at a center portion 624 of the implement 600.

An ear 624 is integrally connected to and extends rearwardly from a rear, bottom end 625 of member 613. The ear 624 has a pair of perforations 625 and 626 for receiving a removable hitch pin 627 for cooperation with, for example, hook 20 of lift hitch 10 or an arm of a front end loader. It will be appreciated that members 614 and 616–617 have similar ears 624.

A curved recess 628 is formed in an upper, front end 629 of member 613. It will be appreciated that a similar recess 628 is formed in members 614 and 616–617.

An ear 630 is integrally connected to and extends frontwardly from an upper front end 631 of central member 615. The ear 630 has an integral tab 632 connected to a front end 633 of top bar 601. A perforation 634 is formed in ear 630. It will be appreciated that members 603 and 604 have similar ears 630, although the ears 630 connected to members 603 and 604 are somewhat narrower in width.

A pair of ears 635 and 636 is connected to central member 615. Ears 635 and 636 are connected to respective, opposite, upper sides 637 and 638 of central member 615 and extend rearwardly therefrom. Each ear 635 and 636 has a curved recess 628 and a pair of perforations 639 and 640 for receiving a removable hitch pin 641 for connection to, for example, hook 18 of lift hitch 10.

A pair of inverted hooks or locks 642 and 643 may be connected to and extend rearwardly from the inside sides 644 and 645 of members 614 and 616. The hooks 642 and 643 cooperate with hitch pins 59 and 54 respectively of the lift hitch 10. The pins 59 and 54 with a pair of respective inverted hooking ends **642*a* and 643*b* of the inverted hooks 642 and 643**.

A planar front support plate 646 is connected to the pallet fork 600. The plate 646 is connected to the front ends 647 of members 613, 614, 615, 616, and 617, the inside front ends 648 of members 603 and 604, and the front, top end 649 of bottom bar 602. The front face of the plate 646 lies flush with the front end 650 of the bottom bar 602.

A removable transverse rod 651 is insertable in perforations 634 of members 603 and 604 and 615. The rod 651 may have perforations 652 in a pair of opposite ends 653 and 654 for receiving a removable pin 655, which secures the rod 651 in the pallet fork implement 600. The rod 651 lies in recesses 628 of members 613, 614, 616, 617, 635, and 636 and is rotatable in recesses 628 and perforations 634.

A pair of pallet forks 656 and 657 are pivotally connected to the rod 651 by a pair of ends 658 and 659 which envelope the rod 651. Perspective ends 658 and 659 of forks 656 and 657 may be slideable transversely on or rigidly connected by a locking device (not shown) to rod 651. Recesses 628 of members 613, 614, 616, 617, 635, and 636 allow ends 658 and 659 to move transversely by and without interference from members 613, 614, 616, 617, 635, and 636.

Ear 647 of central member 615 precludes forks 656 and 657 from contacting each other. Ear 647 also precludes fork 656 from sliding transversely to end 622 and fork 657 from sliding transversely to end 623. It should be noted that ear 647 is sufficiently narrow in length to allow crane attachment 319 to be utilized.

The front planar support plate 646 and the front end 650 of bottom bar 602 provide a planar support for a pair of respective vertical portions 659 and 660 of the forks 656 and 657. The vertical portions 659 and 660 are slideable transversely along the front faces of plate 646 and front end 650 of bottom bar 602.

Furthermore, it should be noted that a plurality of forks 656 and 657 may be mounted on each side 622–633 of the implement 600. The removable rod 651 allows ready placement of a number of forks 656 and 657 on the implement 600 for increased lifting capability, strength and support. The forks 656 and 657 may be locked to the bar 651 by a locking ring (not shown) to preclude pivoting during operation.

Figure 14:
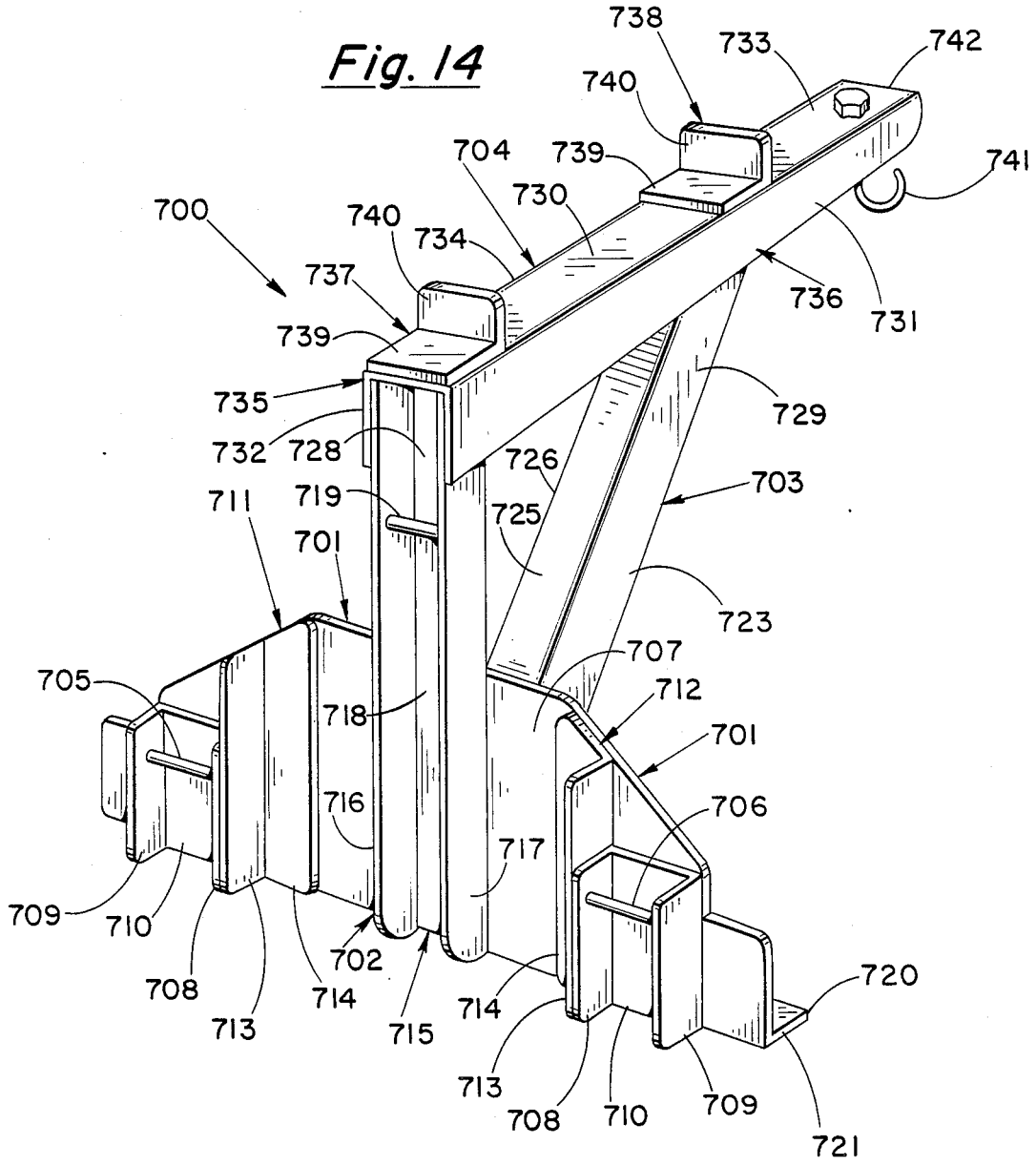
FIG. 14 shows a perspective view of a crane implement connectable to the lift hitch shown in FIG. 1.

A crane implement 700, as shown in FIG. 14, may be attached to the lift hitch 10. The implement 700 has a base 701 connected to a vertical support bar 702 and a diagonal support bar 703. The bars 702 and 703 support a boom 704.

A pair of transverse hitch pins 705 and 706 are connected to a rear end or horizontal support bar 707 of the base 701. Each pin 705 and 706 is transversely oriented in a pair of rearwardly and vertically extending rectangular ears 708 and 709. The ears 708 and 709 are integrally connected to and spaced apart by a back plate 710. The plate 710 is facially connected to the rear end 707 of the base 701. Pins 705 and 706 may cooperate with hooks 20 and 19, respectively, of the lift hitch 10.

A pair of L-shaped braces 711 and 712 are connected to ears 708 and the rear end of 707 of the base 701. Each brace 711 and 712 has a first arm 713 facially connected to ear 708 and a second arm 714 facially connected to the rear end 707 of the base 701. The arms 713 and 714 are integrally connected at substantially right angles to form the L-shape.

Vertical support bar 702 is connected to a rear middle portion 715 of the base 701. Bar 702 has a pair of vertically and rearwardly extending slides 716 and 717 integrally connected at substantially right angles to a central member 718. Central member 718 is facially connected to the rear middle portion 715 of rear end 707. A transverse pin 719 is transversely connected to sides 716 and 717 for cooperation with hook 18 of the lift hitch 10.

The diagonal support bar 703 is connected to and extends frontwardly from the base 701 and a flange 720 horizontally and integrally connected at a substantially right angle to a bottom front end 721 of base 701. The bar 703 has a central member 722 having a pair of members 723 and 724 connected to and extending downwardly from a pair of respective opposite ends 725 and 726 at substantially right angles. A bottom end 727 (not shown) of bar 703 is connected and formed to base 701, flange 720 and the intersection therebetween.

A horizontal boom 704 is connected to the top ends 728 and 729 of the bars 702 and 703, respectively. The boom 704 has a central member 730 having a pair of members 731 and 732 connected to and extending downwardly from a pair of respective opposite ends 733 and 734 at substantially right angles. A rear end 735 of the boom 704 is connected to the top end 728 of bar 702. Members 731 and 732 overlap and facially connect to respective sides 717 and 716 of the bar 702. A middle portion 736 of the boom 704 is connected to the top end 729 of diagonal bar 703. Members 731 and 732 overlap and facially connect to respective sides 723 and 724 of bar 703.

A pair of L-shaped chain-receiving members 737 and 738 are connected to the central member 730 of the boom 704. Each member 737 and 738 has a base 739 and a flange 740 integrally connected at substantially right angles. Each base 739 is facially connected to central member 730. Each flange 740 is placed forwardly of its respective base 739. First member 737 is connected to the rear end 735 of the boom 704. Second member 738 is connected at the middle portion 736 of the boom 704.

A removable hook 741 is removably connected to a front end 742 of the boom 704. The hook 741 is removably insertable in a perforation 743 (not shown) formed in the front end 742 of the boom 704. A pair of curved edges 744 and 745 are formed at the distal front ends of respective sides 731 and 732.

In operation, the lift hitch 10 is first connected to the three point hitch 11 of a tractor. Upper hitch arm 12 is connected to upper pin 16 of the lift hitch 10. Lower hitch arms 13 and 14 are connected to lower pins **17*a* and 17*b***.

Once the lift hitch 10 is connected to a tractor, it may be transported to and connected with an implement such as the hay handler 500, the crane implement 700, or any implement having a conventional three point hitching arrangement or adapted for connection with the mounting device 400.

For connection with an implement having a conventional hitching arrangement, the hooks 19 and 20 may be locked to a rigid, non-retracted position by the brackets 83. A front end 84 of bracket 83 is connected to a hooks 19 and 20 by inserting the removable pin 90 in the orificies 89 and **89*a* formed in bracket 83 and hooks 19 and 20 respectively. A rear end 85 of bracket 83 is connected to a tab 95*a* on the rear end 15 of the lift hitch 10 by inserting a removable pin 94 into orifices 93 and 93*a* formed in bracket 83 and tab 95*a***, respectively.

Top hook 18 may also be locked to a rigid, non-retracted position. A pin may be inserted into a perforation formed in hook 18 and a pair of perforations formed in upright support members 39 and 40. The pin locks hook 18 to the lift hitch 10 in a rigid position.

After the hooks 18, 19 and 20 are rigidly locked to the lift hitch 10, the lift hitch 10 may be moved adjacent the implement to be attached so that the hooks 18, 19 and 20 are aligned directly below their respective three point pin connections of the implement. The lift hitch 10 is then raised vertically so that the hooks 18, 19, and 20 cooperate with their respective three point pin connections.

As lower hooks 19 and 20 cooperate with their respective pin connections such as the pins 520 and 522 of the hay handler 500, the arm 66 of lock 64 automatically pivots into lock 64 when arm 66 is contacted by the pin connection. Arm 66 thereby forces arm 65 to pivot upwardly. When pin 520 or 522 is engaged in the receiving and 82 of hook 19 or 20, end **66*b* of arm 66 pivots outwardly so that end 66*b* abuts pin 520 or 522 to lock the implement to the lift hitch 10**.

As the arms 66 of the lower hooks 19 and 20 lock the pin connections of the implement, upper hook 18 receives its respective upper pin connection. Typically locking arms 66 are not provided for upper hook 18 to allow vertical play between the implement's pin connection and the upper hook 18.

Once the hooks 18, 19 and 20 have connected the lift hitch 10 to the implement, the implement may be transported by the tractor and operated. With the lift hitch 10 attached, the implement may be operated in a similar manner as if it had been attached directly to a conventional three point hitch.

To detach an implement from the lift hitch 10, the distal ends **66*b* of the locking arms 66 are retracted into hooks 19 and 20. The distal ends 66*b* may be retractable by solenoid connections (not shown) operable from the tractor. The distal ends 66*b* may be locked to a retracted postion by the front edge 80*a* of arm 65. The front end 80 is biased to pivot downwardly so that roller 79 of arm 66 may move from edge 71 to edge 80*a* when distal end 66*b*** is being retracted.

After the implement has been disengaged from the lift hitch 10, the distal end **66*b* may be returned to a non-retracted position by pivoting front end 80 upwardly. Front end 80 may be pivoted upwardly by a solenoid (not shown). Since distal end 66*b* is biased to a non-retracted position, it may return to the non-retracted position and roller 79 may return to notch 70 when front end 80 is pivoted upwardly. Once the distal end 66*b* is returned to a non-retracted postion, the lift hitch 10** is ready for automatic attachment to another implement.

To allow the utilization of the mounting device or drawbar receiving slot 45, the mounting device or grappler receiving plate 42, or the mounting device or latching and locking device 400, the hooks 18, 19 and 20 are retracted into the lift hitch 10. The hooks 18, 19 and 20 are pivotable upwardly and rearwardly to retraction into the lift hitch 10. The weight of the hooks 18, 19 and 20 may retain the hooks 18, 19, and 20 in an unobtrusive, retracted position during operation of the other mounting devices 45, 42 and 400.

In operation, the mounting device 45 receives the drawbar 200, which may be inserted into the slot 45 from the front end 21 or rear end 15 of the lift hitch 10. Once the drawbar 200 is in the slot 45, the orifice 204 of the drawbar 200 is aligned with the orifices **212*a* and 212*b* of the support member 211. The removable pin is then inserted through orifices 204, 212*a* and 212*b* to connected the drawbar 200 to the lift hitch 10. The lift hitch 10 may subsequently be operated to operate the drawbar 200** to connected the drawbar to an implement.

In operation, the mounting device 42 is connected to the grappling end 312 of the pallet fork 300. Top edge **42*a* of the front support plate 42 receives the space 312*a* formed by the grappling end 312. The planar rear face 304*a* is supported by the front planar plate 42. Before or after connection to the mounting device 42, fork 301 is pivoted to a perpendicular relationship with grapple 304. When fork 301 is pivoted, second grapple end 312*a* may cooperate with bottom bar 25 is the second grapple 304*a* is being utilized. Rear edge 302*a* of fork 301 abuts bottom edge 303*a* of grapple 304 so that fork 301 may not extend to an obtuse relationship with grapple 304. Typically, a pair of pallet forks 300 are connected to the lift hitch 10. Each fork 300 is connected to an opposing end of the lift hitch 10**.

In operation, an implememt having a latch 421 may be connected to the mounting device 400. The lift hitch 10 is included so that the plate 415 is plaoed forwardly of the bottom bar 25. The lift hitch 10 is then manuevered so that the inverted hooks 422 cooperates and rests upon the pin 403. Subsequently, the lift hitch 10 is raised vertically to raise the implement by the inverted hooks 422 so that end 437 of the pivotal clamp 424 contacts connection 413 and so that front end 101 of the bottom bar 25 contacts the bottom end 428 of the clamp 424. The lift hitch 10 is then further raised so that the front end 101 of the bottom bar 25 is forced to slide frontwardly toward leg 426, which pivots the end 437 of clamp 437 downwardly, and clamping legs 426 and 427 about respective ends 101 and 97 of the bottom bar 25.

As the clamp 424 is clamped to the bottom bar 25, the locking bar 406 is forced to pivot rearwardly by end 437, but is biased to pivot frontwardly to abut a top edge 439 of the clamp 424, thereby locking the clamp 424 to the lift hitch 10.

The latch 421 is uncoupled from the mounting device 400 by the connection 419 being urged rearwardly. As the end 412 of the locking bar 406 clears the top edge 439 of the clamp 424, the coil spring 430 urges and pivots the front end 437 of the clamp 424 toward the main support 431 of the latch 421 from the lift hitch 10. During the uncoupling operation, it may be necessary to manuever the bottom end 25 of the lift hitch 10 downwardly and toward the tractor to assist in removing clamp 424 from bottom bar 25.

In operation, the hay handler 500 may be transported by the lift hitch 10 to an article such as a bale of hay to be moved. The hay handler 500 is connected to the article with the lower hooks 19 and 20 inserted into the respective inlets 591 and 592 formed in pins 519 and 521. Upper hook 18 is connected to pin 524. The hydraulic cylinders 562 and 584 may then be activated together or independently to linearly retract the linearly movable ends 566 and 589. As the ends 566 and 589 are retracted, the pivot arms 558 and 582 pivot to thereby rotate the shaft 549 and rod 581, which in turn pivot the first forks 568, 569, 570, and 571 and the second forks 575, 576, 577, and 578 respectively. At this time, the pivotal ends 563 and 588 of the cylinders 562 and 584 may also pivot as the ends 560 and 583 of the respective pivot arms 558 and 582 pivot and move in a curvilinear path. Since each set of forks 568, 569, 570, and 571 and 575, 576, 577, and 578 are pivotable for more or less 90°, the forks 568–571 and 575–578 may extend to a substantially vertical position in line with the frame 501.

After the forks 568–571 and 575–578 have been pivoted to an open position, the teeth 525, 526, 527, 528, and 529 may be inserted under the article until cylinders 562 and 584 may be activated to extend the respective linearly movable ends 566 and 589 to pivot arms 558 and 582, which rotate shafts 549 and 581, which pivot the forks 568–571 and 575–578 against the article to secure the article against the forks 568–571 and 575–578, the teeth 525–529, and the frame 501 for transport.

In operation of the pallet fork implement 600, the lift hitch 10 is manuevered adjacent the implement 600 inclined so that the upper bar 26 is positioned forwardly of the lower bar 25 and then lifted vertical until the inverted hooking ends 642*a* and 643*a* rests on the pins 59 and 54. The lift hitch 10 is then manuevered to an upright position, during which hooks 18, 19, and 20 cooperate and lock with pins 641, and 627 of the pallet fork implement 600.

Once the pallet fork implement 600 is connected to the lift hitch 10, the implement 600 may be transported to an article to be lifted and the forks 656 and 657 may be independently pivoted and independtly moved transversely on the rod 651 to provide an efficient cooperation between the forks 656 and 657 and the article when the forks 656 and 657 are inserted under or into the article. The lift hitch 10 and the pallet fork implement 600 may also be inclined or reclined to allow the forks 656 and 657 to enter into an efficient lifting arrangement with the article.

When the pallet fork implement 600 lifts and transports the article, it may be most efficient to transport the article with the pallet fork implement 600 in a reclining position. When the implement 600 is in a reclining position, the vertical portions 659 and 660 of the forks 656 and 657 are supported by the plate 646 and the front end 650 of the bottom bar 602.

In operation, the crane implement 704 is connected to the lift hitch 10 in substantially the same manner as the hay handler 500. Subsequently, the flanges 737 and 738 and the hook 741 may be utilized to secure chains or similar connections to the crane implement 700 for lifting, drawing, or transporting articles.

That which is claimed:

1. An interfacing lift hitch for efficiently attaching implements to a tractor, comprising a frame having front and rear ends, attachment means connected to said rear end for connecting said frame to the tractor, said attachment means being accessible from the rear of said frame, first hitching means having a set of three hooks connected to said frame for attachment to an implement, each of said hooks being retractable into said frame between said front and rear ends to provide an unobtrusive front end for said frame, and second hitching means connected to said frame for attachment to an implement and being functional after each of said hooks is retracted whereby implements may be attached to either first or second hitching means.

2. The apparatus of claim 1 wherein at least two of said hooks are pivotally connected to said frame.

3. The apparatus of claim 1 wherein each of said hooks is S-shaped and has two ends, one of said ends protruding from the front end of said frame, a second of said ends being pivotally connected to said frame.

4. The apparatus of claim 1 wherein each of said hooks is retractable independently of each of the other of said hooks.

5. The apparatus of claim 1 wherein each of said hooks is slidable transversely.

6. The apparatus of claim 1 wherein one of said hooks further comprises a lock, said lock having a pair of pivoting, biased arms in a sheath formed in said lock, said arms biased to automatically lock an implement to said hooks and said lift hitch.

7. The apparatus of claim 6 wherein said lock is unlocked automatically by a solenoid operable from a tractor to automatically unlock an implement from said hooks and said lift hitch.

8. The apparatus of claim 1 wherein one of said hooks is rigidly connected to said frame by a bracket, said bracket conforming to the frame to rigidly lock said one hook to said frame.

9. The apparatus of claim 1 wherein said second hitching means comprises drawbar mounting means connected to said frame for mounting a drawbar.

10. The apparatus of claim 9 wherein the drawbar has an orifice and said mounting means comprises a support member connected to said frame and forming a slot for receiving and mounting a drawbar, said support member having an orifice for receiving a pin, said pin cooperating with said orifice of said suppport member and the orifice of the drawbar to secure the drawbar to the lift hitch.

11. The apparatus of claim 1 wherein said second hitching means comprises pallet fork mounting means connected to said frame for mounting a pallet fork.

12. The apparatus of claim 11 wherein the pallet fork has a first grapple and said mounting means comprises a front plate connected to said frame for receiving and mounting the grapple whereby the pallet fork is secured to the lift hitch.

13. The apparatus of claim 12 wherein the pallet fork has a second grapple and said mounting means further comprises a bar connected to said frame for receiving and mounting the second grapple of the pallet fork whereby, after said front plate receives and mounts the first grapple, the bar receives and mounts the second grapple to secure the pallet fork to the lift hitch.

14. The apparatus of claim 12 further comprising a crane attachment, said crane attachment having a transverse support allowing a snug insertion of said pallet fork into said crane attachment.

15. The apparatus of claim 1 wherein said second hitching means further comprises, a pin connected to said lift hitch for cooperating with a hook connected to an implement, a first bar connected to said lift hitch for cooperating with a latch pivotally connected to an implement, and a second bar pivotally connected to said lift hitch for cooperating with and locking said latch to said lift hitch, said pin cooperating with said hook before said first and second bars cooperate with said latch whereby, after said first hitching means are retracted into said lift hitch, said pin and bars cooperate with said respective hook and latch to secure and lock the implement to the lift hitch.

16. The apparatus of claim 1, further comprising a pallet fork implement for attachment to the interfacing lift hitch, the pallet fork implement comprising a frame having a top bar, a bottom bar, a plurality of support members having front ends and connecting said top and bottom bars, and a planar front support plate connected to said front end of said support members, a transverse rod pivotally connected to said support members, a pivotable pallet fork pivotally connected to said rod and supportable by and slidable on said planar front plate, and connecting means attached to said frame for connecting and locking said implement to the interfacing lift hitch said connecting means including a set of three pin connectors, each of said pin connections cooperating with one of said three hooks of the lift hitch.

17. The apparatus of claim 1, further comprising a crane implement for attachment to the interfacing lift hitch, the crane implement comprising a vertical support bar having a pin connection for connection to one of said three hooks of the lift hitch, a horizontal support bar connected to said vertical support bar and having a pair of pin connections for connection to the other two of said three hooks of the lift hitch, a boom connected to and extending frontwardly from said vertical support bar, and a diagonal support bar connected to said horizontal support bar and said boom whereby said crane implement is connectable to the interfacing lift hitch.

* * * * *